US005550568A

United States Patent [19]

Misumi

[11] Patent Number: 5,550,568

[45] Date of Patent: Aug. 27, 1996

[54] INK JET RECORDING WITH TIME-DIVISION DRIVING

[75] Inventor: Yoshinori Misumi, Tokyo, Japan

[73] Assignee: Canon Kabushiki Kaisha, Tokyo, Japan

[21] Appl. No.: 232,395

[22] Filed: Apr. 25, 1994

Related U.S. Application Data

[63] Continuation of Ser. No. 970,641, Nov. 2, 1992, abandoned, which is a continuation of Ser. No. 715,468, Jun. 14, 1991, abandoned.

[30] Foreign Application Priority Data

Jun. 15, 1990 [JP] Japan ..... 2-157003

[51] Int. Cl.[6] ..... B41J 2/05

[52] U.S. Cl. ..... 347/12; 347/40; 347/57

[58] Field of Search ..... 347/12, 13, 40, 347/41, 42, 56, 57

[56] References Cited

U.S. PATENT DOCUMENTS

| | | | |
|---|---|---|---|
| 4,313,124 | 1/1982 | Hara . | |
| 4,334,234 | 6/1982 | Shirato | 347/65 |
| 4,345,262 | 8/1982 | Shirato et al. . | |
| 4,380,771 | 4/1983 | Takatori | 347/65 |
| 4,459,600 | 7/1984 | Sato et al. . | |
| 4,463,359 | 7/1984 | Ayata et al. . | |
| 4,558,333 | 12/1985 | Sugitani et al. . | |
| 4,723,129 | 2/1988 | Endo et al. . | |
| 4,740,796 | 4/1988 | Endo et al. . | |
| 5,089,831 | 2/1992 | Ito | 347/182 |
| 5,132,702 | 7/1992 | Shiozaki | 347/12 |

FOREIGN PATENT DOCUMENTS

| | | | |
|---|---|---|---|
| 0385757 | 9/1990 | European Pat. Off. | B41J 2/16 |
| 133338 | 10/1979 | Japan | B41J 3/04 |
| 59-123670 | 7/1984 | Japan | B41J 3/04 |
| 59-138461 | 8/1984 | Japan | B41J 3/04 |
| 190862 | 10/1984 | Japan | B41J 3/04 |
| 402001310 | 1/1990 | Japan | B41J 2/05 |

OTHER PUBLICATIONS

IBM Technical Disclosure Bulletin, "Ink Jet Velocity Error Compensation", vol. 18, No. 6, Nov. 1975.

*Primary Examiner*—Joseph W. Hartary

*Attorney, Agent, or Firm*—Fitzpatrick, Cella, Harper & Scinto

[57] ABSTRACT

An ink jet recording apparatus comprises a plurality of ink discharge portions having discharge ports for discharging ink, ink channels communicating to the discharge ports, and electricity-heat converters for applying the heat energy to the ink within the ink channels, which electricity-heat converters are divided into plural groups supplied with separate signals for generating heat energy, and a conveying mechanism for conveying a recording medium to be recorded with the ink discharged from the discharge ports. The shapes of the ink discharge ports or other geometrical properties of the apparatus are changed for different groups of electricity heat converters to compensate for variations in the velocity of the ink discharged from the different groups.

28 Claims, 8 Drawing Sheets

INK JET RECORDING WITH TIME-DIVISION DRIVING

This application is a continuation of application Ser. No. 07/970,641 filed Nov. 2, 1992, now abandoned which in turn was a continuation of application Ser. No. 07/715,468, filed Jun. 14, 1991, now abandoned.

BACKGROUND OF THE INVENTION

1. Field of the Invention

The present invention relates to an ink jet recording apparatus, and more particularly to an ink jet recording apparatus for recording onto a recording medium by discharging the ink through discharge ports onto the recording medium by use of the heat energy generated by block driving a plurality of electricity-heat converters.

2. Related Background Art Information

Among various recording methods currently known, the so-called ink jet recording method, which is a non-impact recording method that generates almost no noise during recording and permits printing at high speed onto plain paper without requiring special fixing processing, has been appreciated as a quite effective recording method. Such an ink jet recording method is one in which the recording is performed by discharging fine droplets of recording liquid called ink to apply them onto a recording medium such as paper.

This ink jet recording method is such a method that in recording, electricity-heat converters provided in ink channels (hereafter referred to as nozzles) communicating to fine discharge ports for discharging the ink are energized and heated, thereby heating the ink around heat generating portions (hereafter referred to as heaters) of the electricity-heat converters, and the ink is discharged through the discharge ports by use of the pressure caused by abrupt changes of volumes produced by bubbling. One of the driving methods for an ink jet recording apparatus is a so-called division driving method in which heaters are divided into n groups each for plural bits of a driving signal, which are driven in sequence. The reason is that a current of 250 mA is required to drive one heater normally. Therefore, for example, when 64 nozzles are concurrently driven, a current of 16A will be required, so that a large power supply is needed, or heavy wirings are required to carry large currents. On the contrary, for example, if energization is made each for 16 nozzles in four times, the current required concurrently will be largely reduced up to 4A. Moreover, if energization is made each for eight nozzles in eight times, it can be reduced to 2A.

However, in recording with such a driving method, there is a problem that positions of liquid droplets impinging on a recording medium are different between groups, so that the image quality may be degraded.

It has been found that such impact position shifts between groups are caused by following two factors, as a result of having observed minutely this phenomenon of impact position shifts. The first factor is necessarily caused by the division driving method. That is, it is caused by differences between energization timings for groups, and the relative movement between the recording medium and recording head. The second factor is due to the fact that when a plurality of nozzles are driven in division for discharging substantially at the same time within each group, and at fixed intervals between groups, the discharging speed for the first group being driven first is faster than those for the second and following groups which are sequentially driven.

Next, a specific example of the first factor in recording with a recording head and a recording apparatus to which the above-described conventional division driving is applied will be described. When a head having 64 nozzles is driven at 360 DPI, 6.3 KHz, a pulse width of 3 μs, four division driving pause time of 0.5 μs (see FIG. 7), and a clearance between head and recording medium is 1.2 mm, the impact position shift owing to differences between energization timings for groups which is the first factor as above described is, $$Wt = (3(\mu s) + 0.5(\mu s)) \times (4-1)/(1/6300) \times 10^6 = 0.07 \text{ (see FIG. 8)}$$

That is, a shift of 0.07 dots occurs on recording medium.

The impact position shift Ws owing to differences between discharging speeds for groups, which is the second factor as above described, is shown in Table 1 as given below from experiments of the present inventors.

TABLE 1

| Group | Average discharge speed (m/s) | Reaching time to recording medium (μs) | Shift from dot in first group (dots) |
|---|---|---|---|
| 1 | 12 | 100 | — |
| 2 | 9 | 133 | 0.23 |
| 3 | 8 | 150 | 0.36 |
| 4 | 8 | 150 | 0.38 (See FIG. 9) |

As above described, the impact position shift due to differences between energization timings for groups is small, such as 0.07 dots, and in almost inconspicuous area, but the impact position shift due to differences between discharging speeds for groups may correspond to a maximum of 0.38 dots, having bad effects on the print quality.

SUMMARY OF THE INVENTION

An object of the present invention is to resolve such conventional technical problems, and to provide an ink jet recording head and a recording apparatus using the head, in which impact position shifts are eliminated by making use of merits on the division driving method.

An ink jet recording apparatus according to the present invention comprises, a plurality of ink discharge portions having discharge ports for discharging ink, ink channels communicating to said discharge ports, and electricity-heat converters for applying the heat energy to the ink within said ink channels, means for dividing said plurality of electricity-heat converters into plural groups and supplying a signal generating said heat energy to electricity-heat converters in each group, and conveying means for conveying a recording medium to be recorded with the ink discharged from said discharge ports, wherein the shapes of said ink discharge portions are changed between groups.

According to the present invention as above described, it is possible to dissolve impact position shifts between groups.

BRIEF DESCRIPTION OF DRAWINGS

FIGS. 1A to 6 show examples of an ink jet recording head for use with an ink jet recording apparatus of the present invention, respectively.

FIG. 1A is a typical external perspective view.

FIG. 3 is a typical external perspective view.

FIGS. 4 to 6 are typical views showing cross-sections, respectively.

DETAILED DESCRIPTION OF THE PREFERRED EMBODIMENT

In the following, an example of the present invention will be described in detail with reference to the drawings. In FIGS. 1A to 6, 7 is a recording head, 1 is a substrate, 2 are ink channels (nozzles), 5 is a common liquid chamber for each nozzle, 6 is a partition wall, 8 is a ceiling plate, and 3 are electricity-heat converters (heat generating elements) for generating the heat energy to be used in discharging the ink through discharge ports 4. An ink discharge portion in the present invention includes discharge ports, and ink channels and electricity-heat converters.

If the voltage is applied, the heat generating element 3 is rapidly heated, so that the ink in the vicinity of the heat generating element is instantaneously vaporized and bubbles are grown. By this growth of bubbles, the pressure within the nozzles is increased, so that the balance between the meniscus of ink and external pressure is broken at the face of discharge port 4, and the ink is discharged through the discharge port. At this time, there is already no current flowing through the heat generating element, a heat generating portion of the heat generating element is cooled by the heat transfer with the substrate 1 and the ink, and the temperature on its surface is decreasing. Then, along with the shrinkage of air bubbles, the ink will flow backward from the face of discharge port to the inside of nozzle, and further with new supply of ink, the ink will make contact on the surface of the heat generating portion of heat generating element while air bubbles shrink. As the external pressure is placed at higher level than that of nozzle internal pressure on the face of discharge port, the meniscus is large enough to enter the inside of nozzle. With the capillary action, air bubbles are extinguished by the resupplied ink.

With consecutive repeat of such a mechanism, the ink is discharged, in which the heat generating elements for each group are driven in division from the first group sequentially.

Since the discharging speed of ink is affected by the pressure vibration or temperature propagation between adjacent nozzles, and further subjected to fluidal interference of ink from a liquid chamber to nozzles, the discharging speed is changed in the sequence of bubblings with the division driving. Owing to such causes, the discharging speed from the nozzles in the first group becomes faster.

Figure 1A:
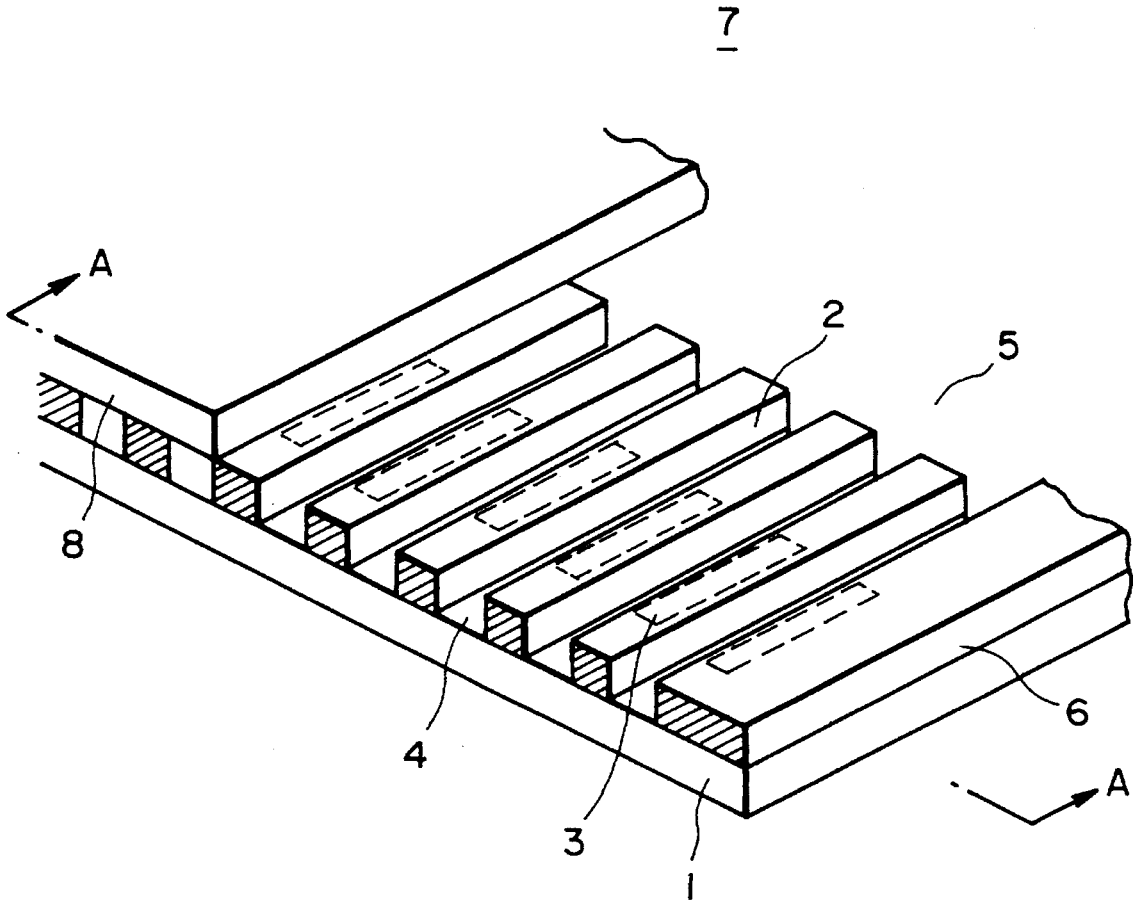
Figure 1B:
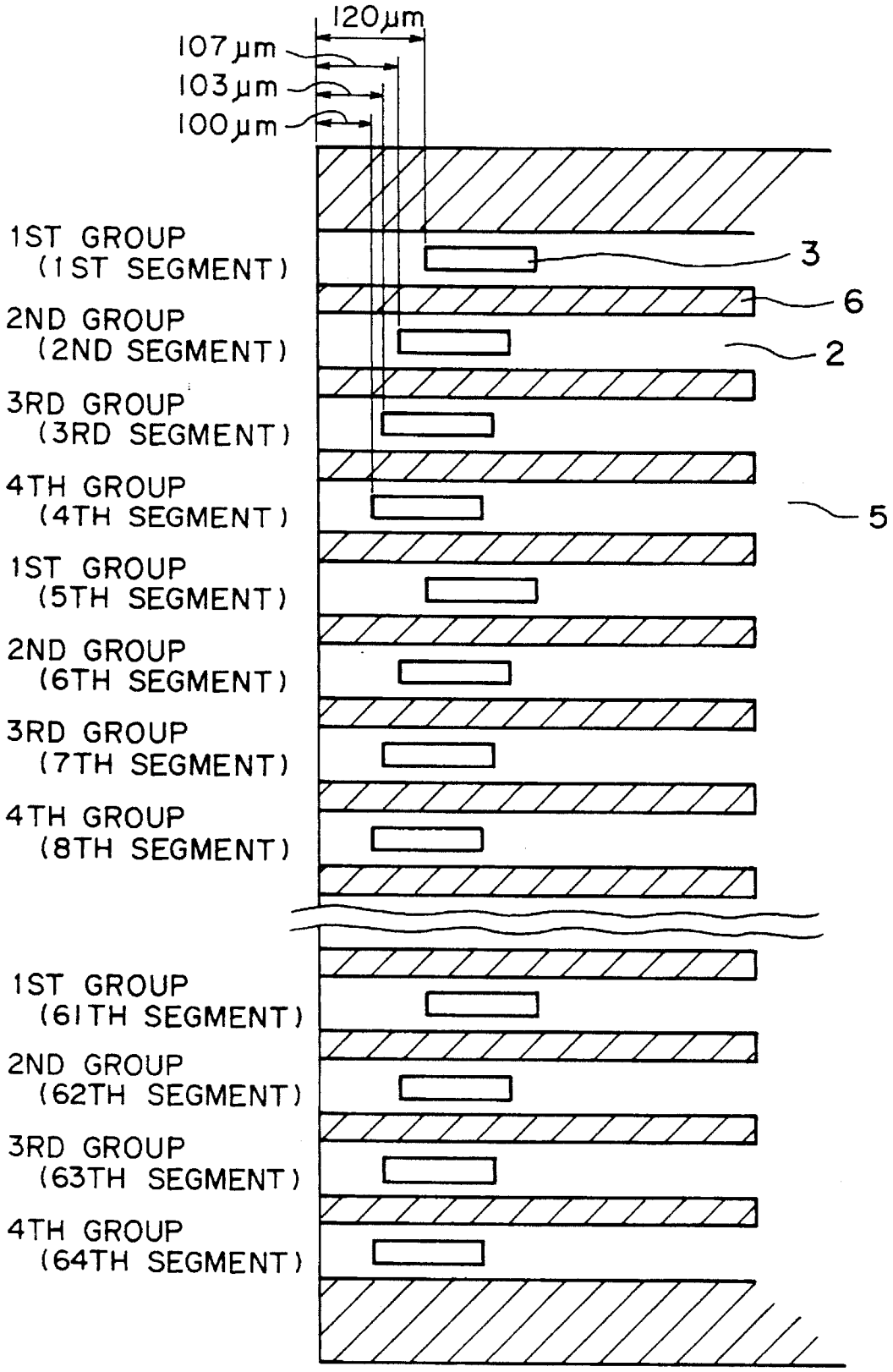
FIG. 1B is a typical view showing a cross-section taken along the line A—A of FIG. 1A.

Next, an example as shown in FIGS. 1A and 1B will be described.

Using a conventional recording head in which a total of 64 nozzles are divided into four groups each for 16 nozzles, each one of common lines is commonly used with four nozzles from the first to fourth groups, and the time division driving (see FIG. 1) is used in four divisions with a driving pulse input for four nozzles being shifted by the amount of pulse width (3 μs)+division driving pause time (0.5 μs), when recording liquid droplets are discharged from all nozzles, it has been found that the discharging speeds are different between groups, as previously described.

Figure 9:
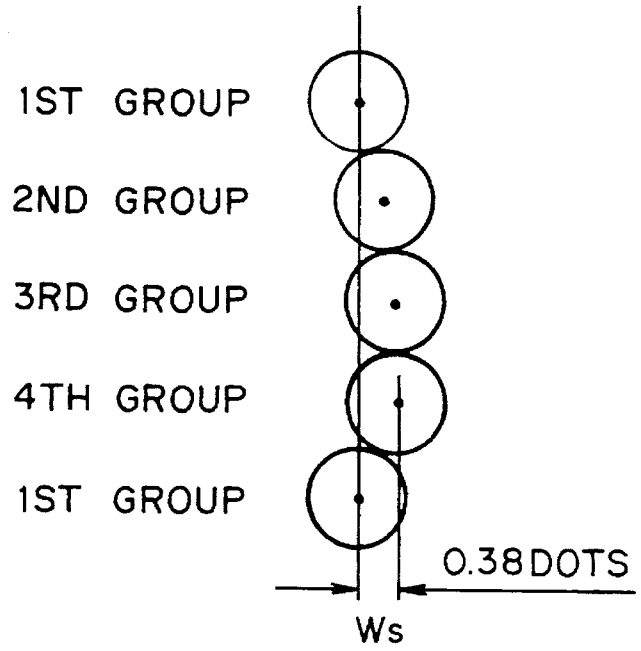
FIG. 9 is a view for explaining impact point shift due to differences between discharging speeds for groups.

That is, its average speed is 12 m/s for the first group, 9 m/s for the second group, and 8 m/s for the third and fourth groups, as shown in Table 1. As a result, the difference between speeds for the first group which is fastest and for the third group which is slowest is 4 m/s, and the impact position has a shift Ws of 0.38 dots at maximum as shown in FIG. 9.

Thus, in this example, the distances between discharge port 4 and heat generating element 3 was set to be 120 μm for the first group (as conventionally), 107 μm for the second group, 103 μm for the third group, and 100 μm for the fourth group, as shown in FIGS. 1A and 1B, in view of differences between discharging speeds. In this case, the average discharging speeds for group were 12 m/s for the first group, 12.4 m/s for the second group, 12.9 m/s for the third group, and 13.4 m/s for the fourth group, respectively, when recording liquid droplets were discharged from the whole nozzles, whereby the difference between maximum speeds for groups could be reduced to 1.4 m/s, and the impact position shift on recording medium was not found in practice.

Figure 2A:
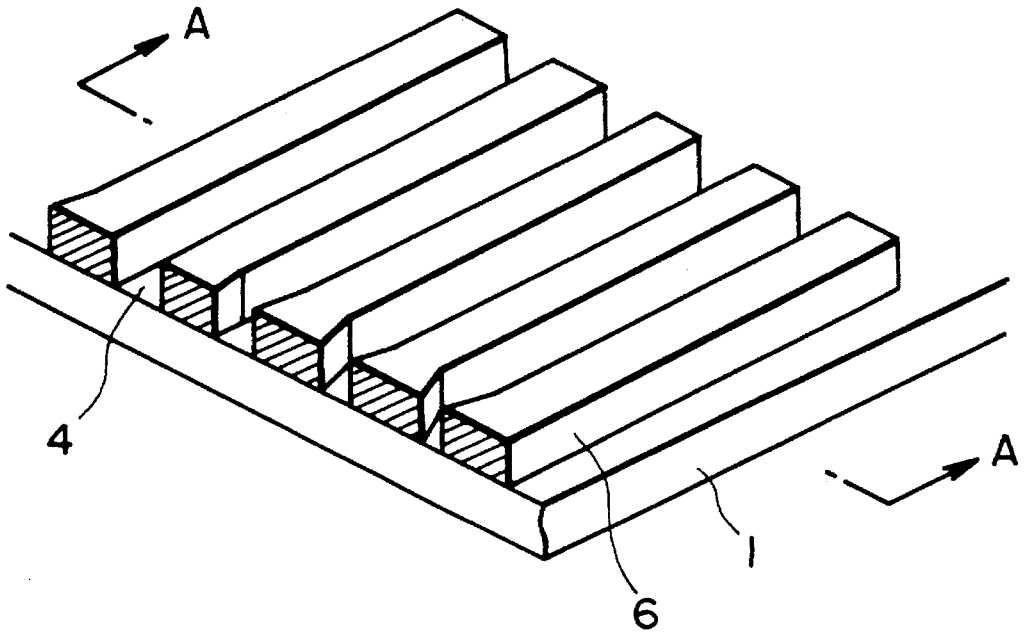
FIG. 2A is a typical external perspective view.
Figure 2B:
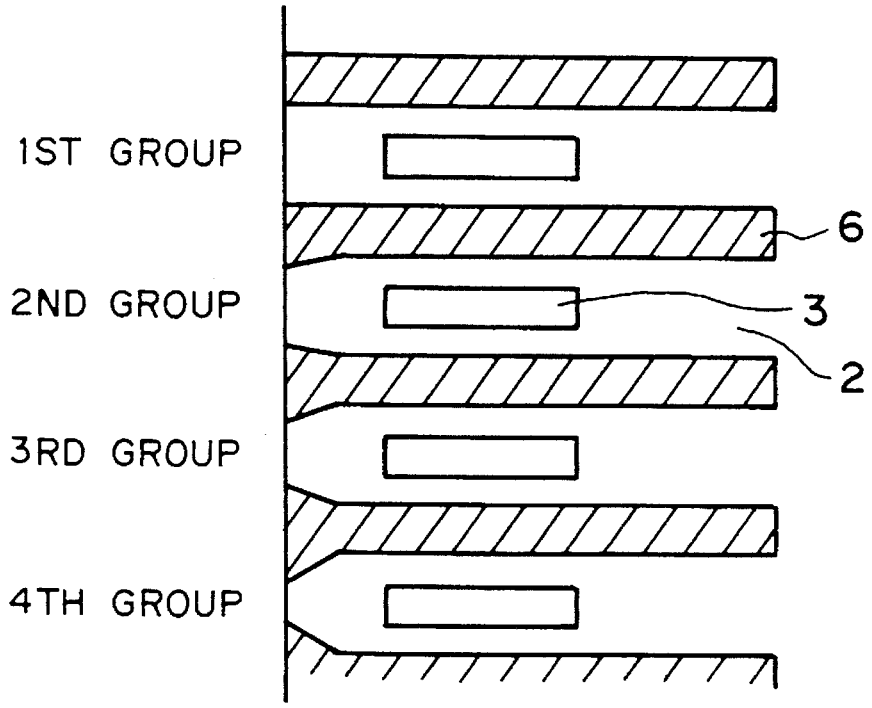
FIG. 2B is a typical view showing a cross-section taken along the line A—A of FIG. 2A.

An example as shown in FIGS. 2A and 2B, with a constitution in which the areas of discharge ports 4 are made smaller from the first group sequentially (or larger from the fourth group sequentially), can compensate for differences between discharging speeds for groups in the same way as for the example shown in FIGS. 1A and 1B, and thus eliminate the impact position shift on recording medium. It should be noted that in this example, the discharging speed is increased by reducing the area of discharge port, which can be determined by taking into consideration the differences between discharging speeds for groups.

Figure 3:
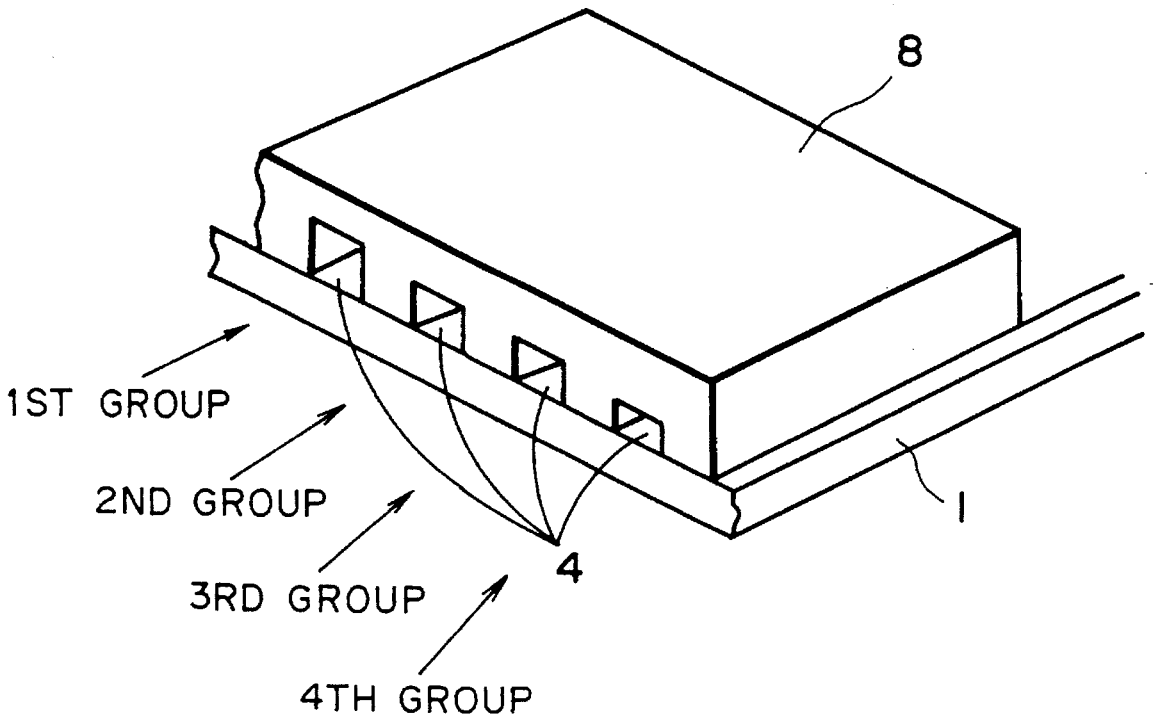

In the example as shown in FIGS. 2A and 2B, the areas of discharge ports are adjusted in a direction of discharge port array, whereas in an example as shown in FIG. 3, the areas of discharge ports are adjusted by changing the lengths in a direction perpendicular to the substrate 1 between groups. Also, this example, with a constitution that the central heights of nozzles are lowered sequentially from the first group (or raised sequentially from the fourth group), can compensate for differences between discharging speeds for groups and eliminate the impact position shift on recording medium in the same way as for the example as shown in FIGS. 1A and 1B.

Figure 4:
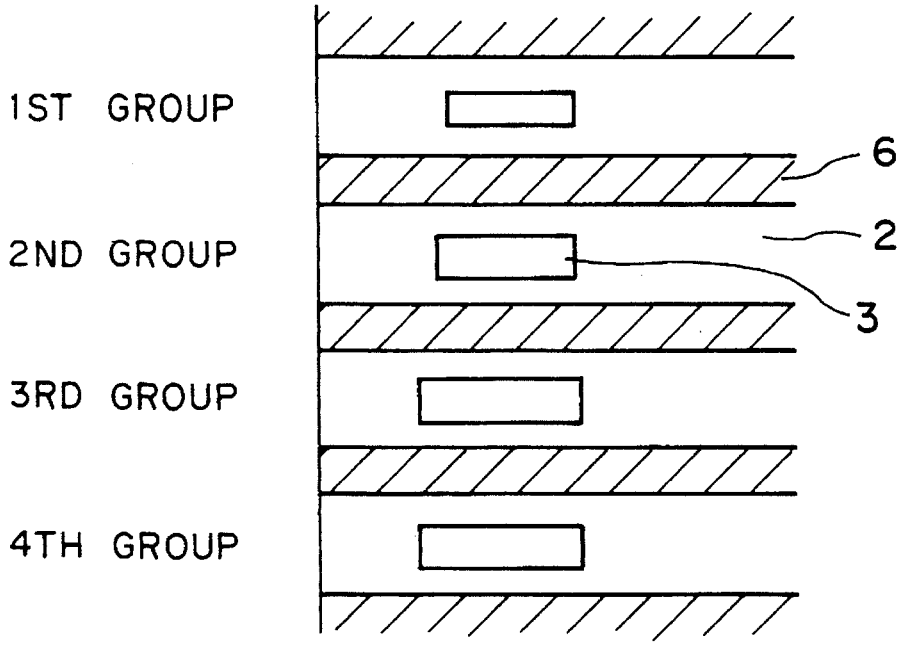

An example as shown in FIG. 4, with a constitution that the areas of heat generating elements 3 are increased sequentially from the first group sequentially, can compensate for differences between discharge speeds for groups and eliminate the impact position shift on recording medium, in the same way as for the example as shown in FIGS. 1A and 1B. Also, it is also feasible by decreasing the resistances of heat generating elements 3 sequentially from the first group with varied ratios between areas or lengths.

Figure 5:
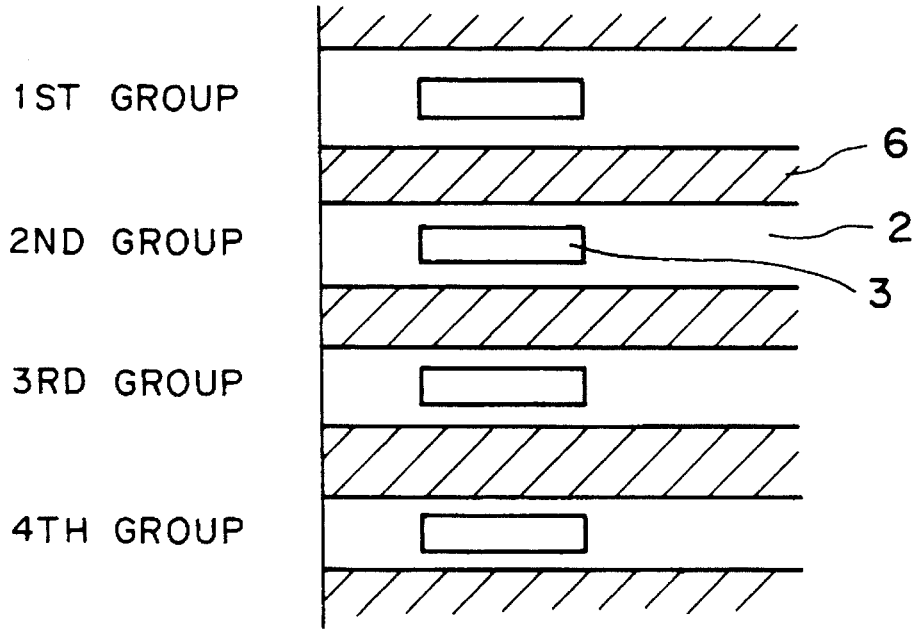

An example as shown in FIG. 5, with a constitution that the widths of nozzles 2 are decreased sequentially from the first group, can compensate for differences between discharging speeds for groups and eliminate the impact position shift on recording medium, in the same way as for the example as shown in FIGS. 1A and 1B.

Figure 6:
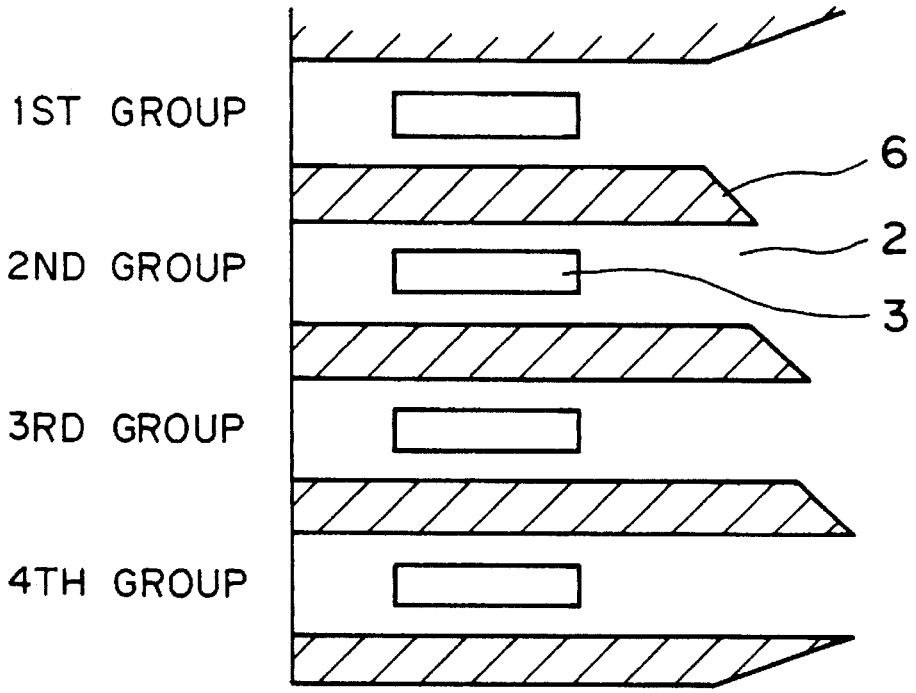
Figure 7:
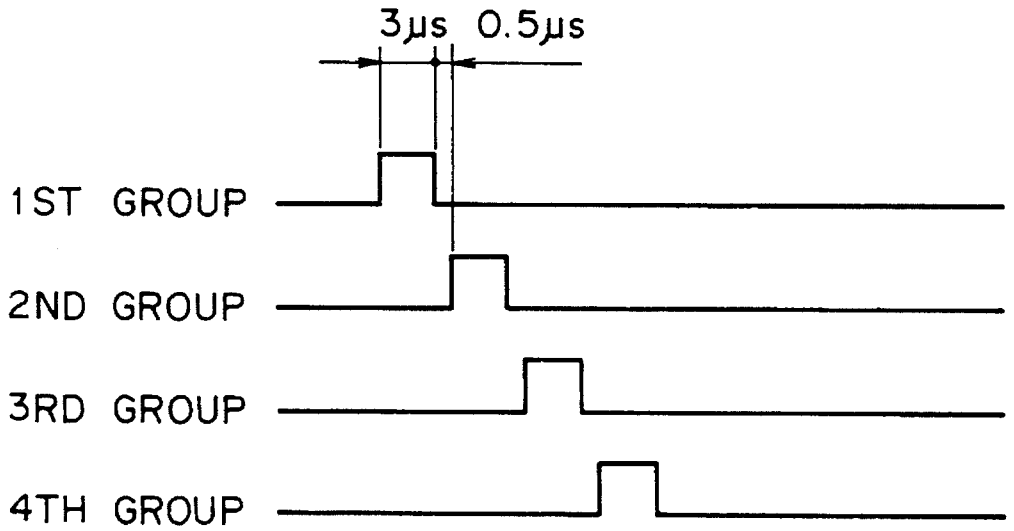
FIG. 7 is a view for explaining the time division driving method.
Figure 8:
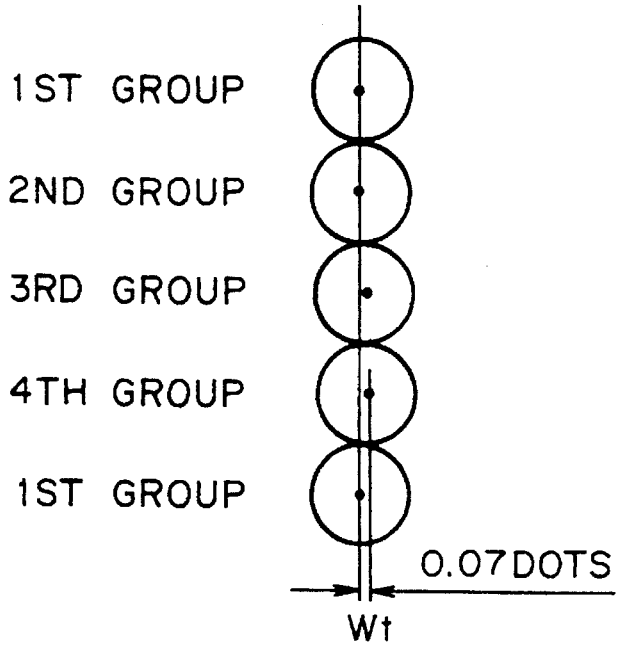
FIG. 8 is a view for explaining impact point shift due to differences between energization timings for groups.

An example as shown in FIG. 6, with a constitution that the lengths of nozzles 2 are increased sequentially from the first group, can compensate for differences between discharging speeds for groups and eliminate the impact position shift on recording medium, in the same way as for the example as shown in FIGS. 1A and 1B.

It will be recognized that each example for compensating for the discharging speed of ink can be fulfilled singly or in combination with other methods.

Figure 10:
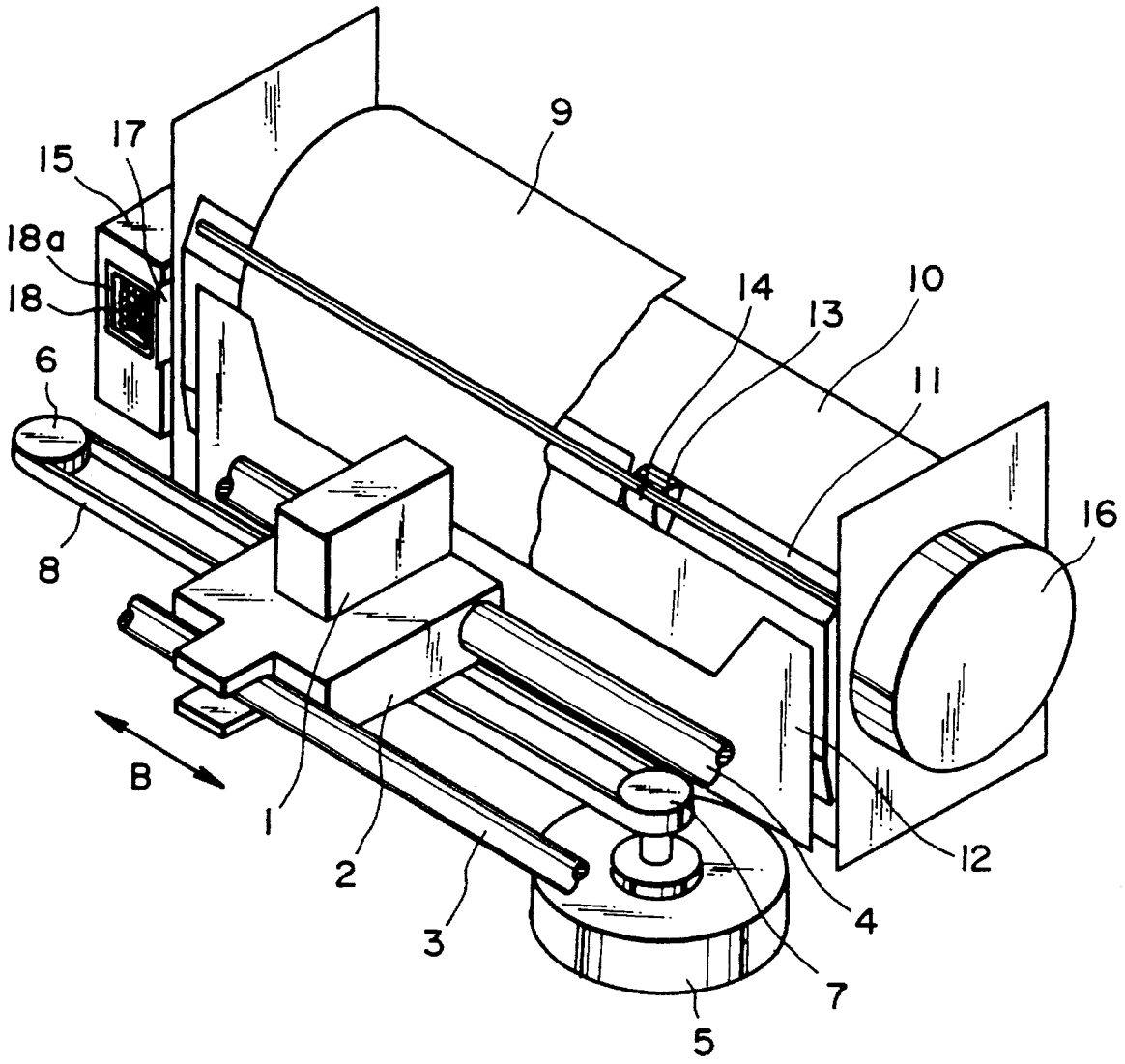
FIG. 10 is a perspective view showing schematically the external constitution of an ink jet recording apparatus in which the division driving is performed with a recording head of the present invention mounted.

FIG. 10 is a perspective view showing schematically the external constitution of an ink jet recording apparatus in which the division driving is performed with a recording head of the present invention mounted. In FIG. 10, 1 is an ink jet recording head (hereafter referred to as a recording head) for recording a desired image by discharging the ink based on a predetermined recording signal, and 2 is a carriage which moves for scanning in a direction of recording line (main scan direction), while mounting the recording head 1 thereon. The carriage 2 is slidably supported by guide shafts 3, 4 and reciprocates in a main scan direction by engagement with a timing belt 8. The timing belt 8 in engagement with pulleys 6, 7 is driven via a pulley 7 by a carriage motor 5.

A recording paper 9 is guided by a paper pan 10 and conveyed by conveying means such as a paper feed roller, not shown, pressed by a pinch roller. This conveyance is performed by a paper feed motor 16 as a driving source. As the recording paper 9 being conveyed is tensioned by a paper exhausting roller 13 and a spur 14 and pressed against a heater 11 by a paper presser plate 12 formed of an elastic member, it is conveyed in close contact with the heater 11. The recording paper 9 on which the ink jetted by the head 4 is deposited is warmed by the heater 11, and deposited ink is fixed on the recording paper with it solvent evaporated. It should be noted that the fixing on heating with the heater 11 is not necessary, but may be provided on a recording apparatus as appropriate in accordance with the characteristics of ink.

15 is a unit referred to as a recovery system for maintaining the discharge characteristics in normal condition by removing foreign matters adhering to discharge ports (not shown) of the recording head 1 or thickened ink. **18*a* is a cap constituting a part of the recovery unit 15, for preventing the occurrence of cloggings by capping the discharge ports of ink jet recording head 1. In the inside of the cap 18*a* is disposed an ink absorber 18**.

On a recording area side of the recovery unit 15 is provided a cleaning blade 17 for cleaning foreign matters or ink droplets adhering to the face of discharge ports by coming into contact with the face on which the discharge ports of recording head 1 are formed.

The present invention brings about excellent effects particularly in a recording head, recording device of ink jet system utilizing heat energy among the ink jet recording systems.

As to its representative constitution and principle, for example, one practiced by use of the basic principle disclosed in, for example, U.S. Pat. Nos. 4,723,129 and 4,740,796 is preferred. This system is applicable to either of the so-called on-demand type and the continuous type. Particularly, the case of the on-demand type is effective because, by applying at least one driving signal which gives rapid temperature elevation exceeding mucleate boiling corresponding to the recording information on electricity-heat converters arranged corresponding to the sheets or liquid channels holding liquid (ink), heat energy is generated at the electricity-heat converters to effect film boiling at the heat acting surface of the recording head, and consequently the bubbles within the liquid (ink) can be formed corresponding one by one to the driving signals. By discharging the liquid (ink) though an opening for discharging by growth and shrinkage of the bubble, at least one droplet is formed. By making the driving signals into pulse shapes, growth and shrinkage of the bubble can be effected instantly and adequately to accomplish more preferably discharging of the liquid (ink) particularly excellent in response characteristic. As the driving signals of such pulse shape, those as disclosed in U.S. Pat. Nos. 4,463,359 and 4,345,262 are suitable. Further excellent recording can be performed by employment of the conditions described in U.S. Pat. No. 4,313,124 of the invention concerning the temperature elevation rate of the above-mentioned heat acting surface.

As the constitution of the recording head, in addition to the combination constitutions of discharging orifice, liquid channel, electricity-heat converter (linear liquid channel or right angle liquid channel) as disclosed in the above-mentioned respective specifications, the constitution by use of U.S. Pat. Nos. 4,558,333 or 4,459,600 disclosing the constitution having the heat acting portion arranged in the flexed region is also included in the present invention. In addition, the present invention can be also effectively made the constitution as disclosed in Japanese Patent Application Laid-Open No. 59-123670 which discloses the constitution using a slit common to a plurality of electricity-heat converters as the discharging portion of the electricity-heat converter or Japanese Patent Application Laid-Open No. 59-138461 which discloses the constitution having the opening for absorbing pressure wave of heat energy correspondent to the discharging portion.

Further, as the recording head of the full line type having a length corresponding to the maximum width of recording medium which can be recorded by the recording device, either the constitution which satisfies its length by combination of a plurality of recording heads as disclosed in the above-mentioned specifications or the constitution as one recording head integrally formed may be used, and the present invention can exhibit the effects as described above further effectively.

In addition, the present invention is effective for a recording head of the freely exchangeable chip type which enables electrical connection to the main device or supply of ink from the main device by being mounted on the main device, or for the case by use of a recording head of the cartridge type provided integrally on the recording head itself.

Also, addition of a restoration means for the recording head, a preliminary auxiliary means, etc. provided as the constitution of the recording device of the present invention is preferable, because the effect of the present invention can be further stabilized. Specific examples of these may include, for the recording head, capping means, cleaning means, pressurization or aspiration means, electricity-heat converters or another heating elements or preliminary heating means according to a combination of these, and it is also effective for performing stable recording to perform preliminary mode which performs discharging separate from recording.

Further, as the recording mode of the recording device, the present invention is extremely effective for not only the recording mode only of a primary color such as black etc., but also a device equipped with at least one of plural different colors or full color by color mixing, whether the recording head may be either integrally constituted or combined in plural numbers.

Further, the form of ink jet recording apparatus according to the invention, in addition to what is used as image output terminal of a data processing apparatus such as computers, may be those of a copying apparatus combined with readers or facsimile apparatus having transmitting and receiving functions.

The present invention has the effects as will be described below by making the constitution as previously shown. That is, a recording apparatus for driving a plurality of nozzles for each group or a recording head mounted on such recording apparatus, with the adjustment of discharging speed for ink droplets by changing the shape or size of ink discharge portion for each group, can compensate for differences between ink discharging speeds for groups in the conventional head form, thereby improving the precision of impact point of liquid droplet on recording medium and enabling the high quality of print.

I claim:

1. An ink jet recording apparatus comprising:

a plurality of ink discharge portions, each having predetermined shape and including a plurality of discharge ports corresponding thereto for discharging an ink, a plurality of ink channels communicating with said discharge ports and containing the ink therein, and a plurality of ink discharge elements corresponding thereto for discharging the ink contained within said ink channels onto a recording medium, said ink which has been discharged from each discharge port forming a droplet which strikes the recording medium at an impact position;

driving means for driving said ink discharge elements with a drive timing;

means for dividing said ink discharge elements and corresponding said discharge ports into a plurality of groups for separate driving, such that each of the groups is driven by a drive signal with a different drive timing therebetween for driving the ink discharge elements in that said group; and conveying means for conveying a recording medium to be recorded with the ink discharged from said discharge ports, wherein the shapes of at least some of said ink discharge portions are different from one another so as to reduce a deviation between the impact positions of the ink droplets in accordance with the different drive timing between said groups.

2. An ink jet recording apparatus according to claim 1, wherein the shapes of said ink discharge portions are such that a width of a given said ink channel which is in a particular said group is smaller than the width of those said ink channels which are in the group to which the signal is supplied later.

3. An ink jet recording apparatus according to claim 1, wherein the shapes of said ink discharge portions are such that a length of a given said ink channel which is in a particular said group to which the signal is supplied later is longer than a length of other said ink channels in the group to which the signal is supplied earlier.

4. An apparatus according to claim 1, wherein said ink discharge elements comprise electrothermal converters for applying heat energy to the ink.

5. An apparatus according to claim 1, wherein a distance between at least one said discharge port and an associated said ink discharge element is different with regard to the groups of said ink discharge portions and said corresponding discharge ports.

6. An ink jet recording apparatus according to claim 5, wherein the shapes, of said ink discharge portions are such that the distance between said at least one discharge port and said associated ink discharge element which is in a particular said group is shorter than the distance for those said groups to which the drive signal is supplied later.

7. An apparatus according to claim 1, wherein an area of at least one said discharge port is different with regard to the groups of said ink discharge portions and said corresponding discharge ports.

8. An ink jet recording apparatus according to claim 7, wherein the shapes of said ink discharge portions are such that the area of said at least one discharge port which is in a particular said group for which the signal is supplied later is smaller than an area of each said discharge port in other said groups.

9. An apparatus according to claim 1, wherein a central height of at least one said discharge port is different with regard to the groups of said ink discharge portions and said corresponding discharge ports.

10. An ink jet recording apparatus according to claim 9, wherein the shapes of said ink discharge portions are such that the central height of said at least one discharge port which is in a particular said group for which the signal is supplied later is lower than the central height of each said discharge port in other said groups.

11. An apparatus according to claim 1, wherein an area of at least one said ink discharge element is different with regard to the groups of said ink discharge portions and said corresponding discharge ports.

12. An ink jet recording apparatus according to claim 11, wherein the shapes of said ink discharge portions are such that the area of said at least one ink discharge element which is in a particular said group to which the drive signal is supplied sooner is smaller than the areas of those said elements which are in the group to which the drive signal is supplied later.

13. An apparatus according to claim 1, wherein a resistance value of at least one said ink discharge element is different with regard to the groups of said ink discharge portions and said corresponding discharge ports.

14. An ink jet recording apparatus according to claim 13, wherein the resistance value of said at least one ink discharge element which is in a particular said group is smaller than the resistances of those said elements which are in the group to which a drive signal is supplied later.

15. An ink jet recording head driven by a time-division driving signal from a recording apparatus having driving means for driving with a drive timing, the recording head comprising:

a plurality of ink discharge portions, each having a predetermined shape and including a plurality of discharge ports corresponding thereto for discharging an ink, a plurality of ink channels communicating with said discharge ports and containing the ink therein, and a plurality of ink discharge elements corresponding thereto for discharging the ink contained within said ink channels onto a recording medium, said ink which has been discharged from each said discharge port forming a droplet which strikes the recording medium at an impact position, wherein said ink discharge elements are divided into a plurality of groups for separate driving by said driving means, which supplies a drive signal to the ink discharge elements, such that each of the groups is driven with a different said drive timing therebetween for driving the ink discharge elements in that said group, said ink discharge portions having different shapes so as to reduce a deviation between the impact positions of the ink droplets in accordance with the different drive timing between said groups.

16. An ink jet recording head according to claim 15, wherein the shapes of said ink discharge portions are such that a width of a given said ink channel which is in a particular said group is smaller than the width of those said ink channels which are in the group to which the signal is supplied later.

17. An ink jet recording head according to claim 15, wherein the shapes of said ink discharge portions are such that a length of a given said ink channel which is in a particular said group to which the signal is supplied later is longer than a length of other said ink channels in the group to which the signal is supplied earlier.

18. An ink jet recording head according to claim 15, wherein said ink discharge elements comprise electrothermal converters for applying heat energy to the ink.

19. An apparatus according to claim 15, wherein a distance between at least one said discharge port and an associated said ink discharge element is different with regard to the groups of said ink discharge portions and said corresponding discharge ports.

20. An ink jet recording head according to claim 19, wherein the shapes of said ink discharge portions are such that a distance between said at least one discharge port and said associated ink discharge element which is in a particular said group is shorter than the distance for those said groups to which the drive signal is supplied later.

21. An apparatus according to claim 15, wherein an area of at least one said discharge port is different with regard to the groups of said ink discharge portions and said corresponding discharge ports.

22. An ink jet recording head according to claim 21, wherein the shapes of said ink discharge portions are such that the area of said at least one discharge port which is smaller in a particular said group for which the signal is supplied later is smaller than an area of each said discharge port in other said groups.

23. An apparatus according to claim 15, wherein a central height of at least one said discharge port is different with regard to the groups of said ink discharge portions and said corresponding discharge ports.

24. An ink jet recording head according to claim 23, wherein the shapes of said ink discharge portions are such that the central height of said at least one discharge port which is lower in a particular said group for which the signal is supplied later is lower than a central height of each said discharge port in other said groups.

25. An apparatus according to claim 15, wherein an area of at least one said ink discharge element is different with regard to the groups of said ink discharge portions and said corresponding discharge ports.

26. An ink jet recording head according to claims 25, wherein the shapes of said ink discharge portions are such that the area of said at least one ink discharge element which is in a particular said group to which the drive signal is supplied sooner is smaller than the area of those said elements which are in the group to which the drive signal is supplied later.

27. An apparatus according to claim 15, wherein a resistance value of at least one said ink discharge element is different with regard to the groups of said ink discharge portions and said corresponding discharge ports.

28. An ink jet recording head according to claim 27, wherein the resistance value of said at least one ink discharge element which is in a particular said group is smaller than the resistances of those said elements which are in the group to which the drive signal is supplied later.

* * * * *

UNITED STATES PATENT AND TRADEMARK OFFICE

CERTIFICATE OF CORRECTION

PATENT NO. : 5,550,568

DATED : August 27, 1996

INVENTORS : YOSHINORI MISUMI

It is certified that error appears in the above-identified patent and that said Letters Patent is hereby corrected as shown below:

ON THE COVER PAGE

In [56] References Cited, under FOREIGN PATENT DOCUMENTS:

"402001310 1/1990 Japan" should read --2-1310 1/1990 Japan--.

IN THE DRAWINGS

Sheet 2 of 8, FIG. 1B "(61TH" should read --(61ST--;
"(62TH" should read --(62ND--;
"(63TH" should read --(63RD--.

COLUMN 5

Line 42, "it" should read --its--.

UNITED STATES PATENT AND TRADEMARK OFFICE

CERTIFICATE OF CORRECTION

PATENT NO. : 5,550,568

DATED : August 27, 1996

INVENTOR : YOSHINORI MISUMI

It is certified that error appears in the above-identified patent and that said Letters Patent is hereby corrected as shown below:

COLUMN 8

Line 7, "shapes," should read --shapes--.

Signed and Sealed this

Seventh Day of January, 1997

*Attest:*

Bruce Lehman

BRUCE LEHMAN

*Attesting Officer*

*Commissioner of Patents and Trademarks*